United States Patent [19]

McCowin

[11] Patent Number: 4,932,094

[45] Date of Patent: Jun. 12, 1990

[54] LIQUID APPLICATOR TOOL

[75] Inventor: Peter D. McCowin, Enumclaw, Wash.

[73] Assignee: The Boeing Company, Seattle, Wash.

[21] Appl. No.: 289,614

[22] Filed: Dec. 22, 1988

[51] Int. Cl.[5] ..... A46B 13/04

[52] U.S. Cl. ..... 15/29; 222/387; 222/389; 401/270; 401/288

[58] Field of Search ..... 15/29; 222/387, 389, 222/502; 401/270, 286, 288

[56] References Cited

U.S. PATENT DOCUMENTS

| | | | |
|---|---|---|---|
| 1,782,681 | 11/1930 | Foss et al. . | |
| 3,056,151 | 10/1962 | Vlacancich | 15/29 |
| 3,084,069 | 4/1963 | Simon | 15/29 X |
| 3,221,947 | 12/1965 | Penn | 222/389 X |
| 3,764,045 | 10/1973 | Ornsteen . | |
| 3,775,016 | 11/1973 | Adams . | |
| 3,906,573 | 9/1975 | Crawford | 15/22 R |
| 4,208,753 | 6/1980 | Lewis | 15/29 |
| 4,299,336 | 11/1981 | Studer | 222/387 X |
| 4,312,091 | 1/1982 | Cardus | 15/97 A |
| 4,321,722 | 3/1982 | Klocke | 15/29 |

FOREIGN PATENT DOCUMENTS

| | | | |
|---|---|---|---|
| 2155427 | 5/1973 | Fed. Rep. of Germany | 222/389 |
| 2216598 | 10/1973 | Fed. Rep. of Germany | 222/389 |
| 300709 | 11/1928 | United Kingdom . | |

*Primary Examiner*—Edward L. Roberts

*Attorney, Agent, or Firm*—Dellett, Smith-Hill & Bedell

[57] ABSTRACT

An applicator tool includes a housing for holding a disposable cartridge containing liquid such as glue, caulk or sealant. The cartridge has a flexible nozzle at one end and a plunger at another end. To dispense liquid from the cartridge, the applicator tool supplies air pressure behind the plunger to drive the plunger toward the nozzle, thereby forcing the liquid through the nozzle. To stop dispensing liquid from the cartridge, the applicator tool removes driving pressure on the plunger and clamps the nozzle between two pistons so that the liquid cannot flow through the nozzle. The applicator tool also includes a rotatable brush mounted on the housing and a pneumatic motor within the housing for rotating the brush. The tip of the cartridge nozzle extends out of the housing and into the brush, and as liquid flows out of the nozzle the rotating brush spreads the liquid onto a surface. A trigger mounted on the housing operates valves providing supplying air to the cartridge plunger, operating the nozzle clamping pistons, and driving the pneumatic motor.

17 Claims, 5 Drawing Sheets

LIQUID APPLICATOR TOOL

BACKGROUND OF THE INVENTION

This invention relates in general to a liquid applicator tool, and in particular to a tool for dispensing liquid from a disposable cartridge and for brushing the dispensed liquid onto a surface.

A disposable cartridge containing liquid such as glue, sealant or caulk is usually cylindrical in shape and includes a nozzle at one end and a plunger in the other end. A well known dispensing tool (often called a "caulking gun") uses a trigger operated ratchet mechanism to ratchet the plunger toward the nozzle, thereby forcing liquid out of the nozzle. The rate at which the operator depresses the trigger controls the rate at which the tool dispenses liquid, but liquid may continue to flow after the user releases the trigger until discharge of liquid from the cartridge reduces ratchet pressure on the plunger. Some tools include a lever for releasing ratchet pressure on the plunger so as to stop liquid flow. However after releasing ratchet pressure on the plunger, an operator may have to depress the trigger more than once to build up sufficient pressure to restart liquid flow.

In some applications workmen must brush sealant dispensed from a cartridge onto a surface. For example, spaces between spars in an airplane wing are often used for storing fuel. To prevent leakage of fuel at joints where wing skin sections meet over spars, workmen brush sealant on the joints. Since the sealant consists of components that react together at ambient temperature, about 18° C., the components are premixed and packaged in disposable plastic cartridges and frozen until used. When required, a cartridge is thawed. Workmen have found it difficult to use a dispensing tool and a brush at the same time. Therefore workmen typically find it easier to dispense the sealant from the cartridge into an open container and then apply the sealant with a paint brush dipped into the container. This method of dispensing and applying the sealant is laborious and time-consuming.

SUMMARY OF THE INVENTION

In accordance with the invention, an applicator tool includes a housing for holding a disposable cartridge containing liquid such as glue, caulk or sealant. The cartridge has a flexible nozzle at one end and a plunger at another end. To dispense liquid from the cartridge, the applicator tool supplies air pressure behind the plunger to drive the plunger toward the nozzle thereby forcing the liquid through the nozzle. To stop dispensing liquid from the cartridge, the applicator tool removes driving pressure on the plunger and clamps the nozzle between two pistons so that the liquid cannot flow through the nozzle.

In accordance with another aspect of the invention, the applicator tool includes a circular, rotatable brush mounted on the housing. A pneumatic motor within the housing rotates the brush. The tip of the cartridge nozzle extends out of the housing and into the brush, and as liquid flows out of the nozzle the rotating brush spreads the liquid onto a surface.

In accordance with a further aspect of the invention, a trigger mounted on the housing operates valves controlling air pressure on the cartridge plunger, operating the nozzle clamping pistons, and driving the pneumatic motor. When an operator releases the trigger it springs to a first position causing the valves to cut off air supply to the motor and to the cartridge plunger but to supply air to the nozzle clamping pistons. Thus the motor does not rotate the brush, the plunger does not pressurize the liquid in the cartridge, and the clamping pistons clamp the nozzle shut, thereby preventing any liquid from flowing out of the cartridge.

When the operator depresses the trigger to a second position, a control valve supplies air to the pneumatic motor and the motor begins to rotate the brush. When the operator further depresses the trigger to a third position, the control valves supply air to the cartridge plunger and shut off air supply to the nozzle clamping pistons so that the tool dispenses liquid through the rotating brush.

It is accordingly an object of the invention to provide a tool for dispensing precisely controlled amounts of liquid from a disposable cartridge.

It is another object of the invention to provide a tool for brushing liquid dispensed from a cartridge onto a surface.

The surface matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

DETAILED DESCRIPTION

Figure 1:
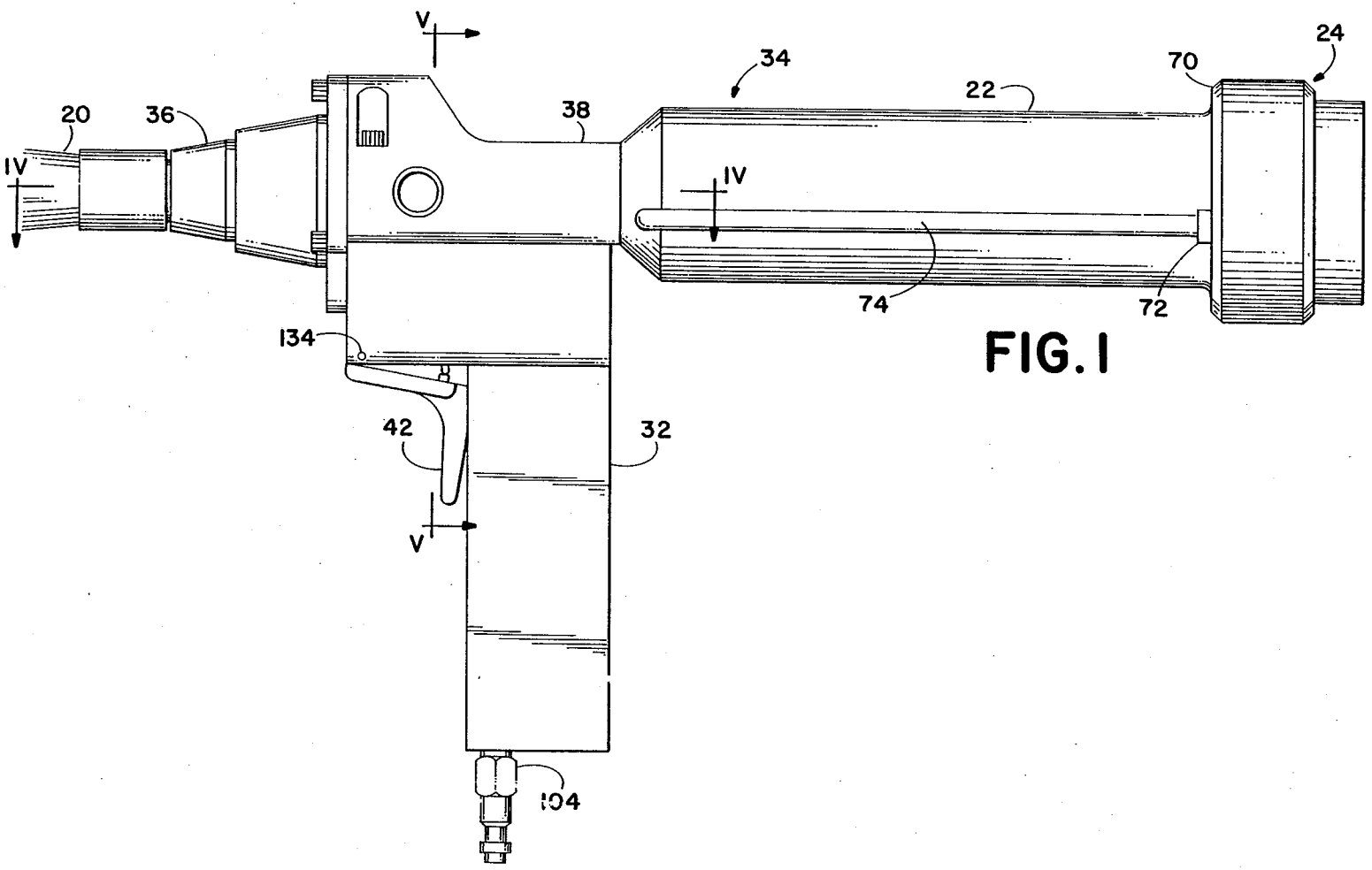
FIG. 1 is a side elevation of the tool embodying the present invention.

With reference to FIG. 1, the present invention is a tool for dispensing liquid such as glue or sealant from a disposable cartridge contained within the tool and for brushing the dispensed liquid onto a surface. When an operator depresses a trigger 42 on the tool, a circular brush 20 on the end of a tool begins to rotate. When the operator depresses the trigger further, the tool forces liquid out of the cartridge, through the rotating brush and onto the surface. Thus the tool of the present invention permits an operator to simultaneously dispense liquid from a disposable cartridge and brush the dispensed liquid onto a surface. The tool also allows the operator to actuate the brush without dispensing liquid.

Figure 2:
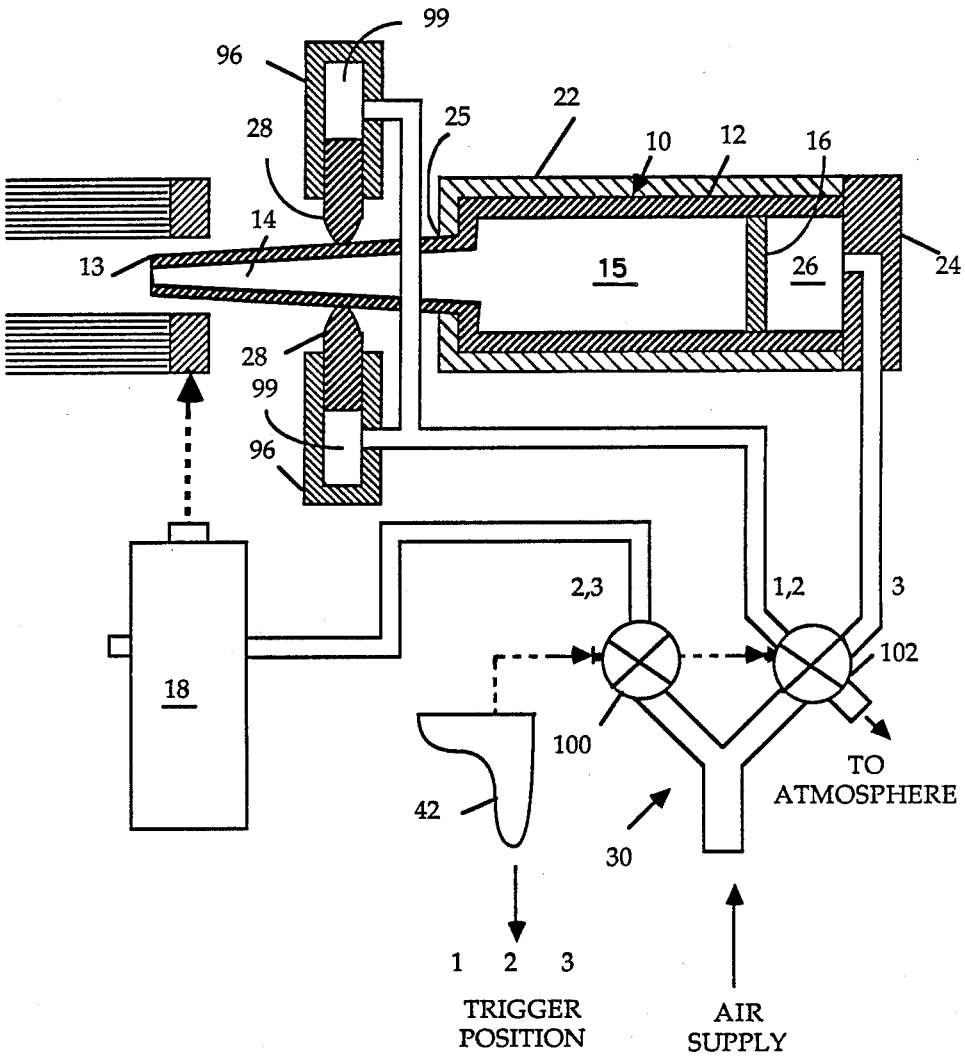
FIG. 2 is a schematic diagram of a pneumatic system for the tool of FIG. 1.

FIG. 2 illustrates pneumatic and mechanical features of the liquid applicator tool in simplified schematic form. A disposable cartridge 10 has a cylindrical container 12 for storing the liquid 15, a flexible nozzle 14 at one end of container 12 for dispensing liquid 15, and a plunger 16 slidably fitting within the other end of container 12 such that liquid 15 is confined in container 12 between nozzle 14 and plunger 16. Cartridge 10 fits within a casing 22 of the applicator tool with nozzle 14 extending through an aperture 25 in casing 22. A removable end plug assembly 24 seals casing 22 to form a pressure chamber 26 between plunger 16 and end plug assembly 24. Pressurized air supplied to chamber 26 forces plunger 16 forward to expel liquid 15 from container 12 through nozzle 14.

A pair of pistons 28 positioned in cylinders 96 on opposite sides of nozzle 14 selectively pinch the flexible nozzle to prevent liquid from flowing through the nozzle when air is supplied to pressure chambers 99 behind pistons 28 within cylinders 96. When chambers 99 are vented and chamber 26 is pressurized, liquid 15 under pressure in container 12 flows out through nozzle 14, forcing pistons 28 apart. Thus to dispense liquid from cartridge 10 the tool supplies air to chamber 26 and vents chambers 99. To stop dispensing liquid from cartridge 10, the tool vents chamber 26 and turns on the air supply to chambers 99.

A pneumatic motor 18 rotates brush 20 mounted on the tool. Tip 13 of nozzle 14 extends into the center of brush 20, and as nozzle 14 dispenses liquid through tip 13, brush 20 rotates to brush the liquid onto a surface.

An air control system 30, including valves 100 and 102 operated by trigger 42, controls air flow to chamber 26, chambers 99 and motor 18. Air control system 30 has three states corresponding to three positions of trigger 42. In the first position (trigger 42 released) valve 102 supplies air to chambers 99, thereby clamping nozzle 14 and preventing liquid from flowing through the nozzle. Valve 102 vents chamber 26 and valve 100 does not supply air to motor 18. Thus no liquid flows through nozzle 14 and brush 20 does not rotate. When an operator depresses trigger 42 to a second position, valve 102 continues to supply air to chambers 99 and vent chamber 26 but valve 100 now supplies air to motor 18. Thus motor 18 rotates brush 20 but the tool dispenses no liquid from cartridge 10.

When the operator depresses the trigger further to a third position, valve 100 continues to supply air to motor 18 but valve 102 now supplies air to chamber 26 and vents chambers 99, allowing pistons 28 to retract. The pressure in chamber 26 drives plunger 16 forward thereby forcing liquid 15 through nozzle 14 and into rotating brush 20. The liquid flowing through nozzle 14 drives pistons 28 apart since chamber 99 is no longer pressurized.

With reference to FIGS. 1, 3, 4 and 5, the applicator tool comprises a housing 34 including casing 22, end plug assembly 24, a handle 32 and a forward section 38. An operator mounts brush 20 in a chuck 36 rotatably attached to the front of forward section 38. The operator installs a disposable cartridge 10 within casing 22 by removing end plug assembly 24, slipping the cartridge into casing 22, and replacing end plug assembly 24. Forward section 38 contains clamping pistons 28 and valves 100 and 102 implementing the air control system 30 of FIG. 2. Trigger 42 pinned to the underside of forward section 38 operates the control valves. Handle 32 contains pneumatic motor 18. A gear train 44 in forward section 38 couples the motor to brush chuck 36. An external compressor (not shown) supplies air to valves 100 and 102 through an air hose coupling 104 at the bottom of handle 32 and a passageway 105 in the handle. An air tube 74 mounted on the outside of casing 22 delivers air from valve 102 in forward section 38 through a port 72 at a flared end 70 of casing 22 and into the pressure chamber 26 behind cartridge plunger 16 within casing 22.

Figure 3:
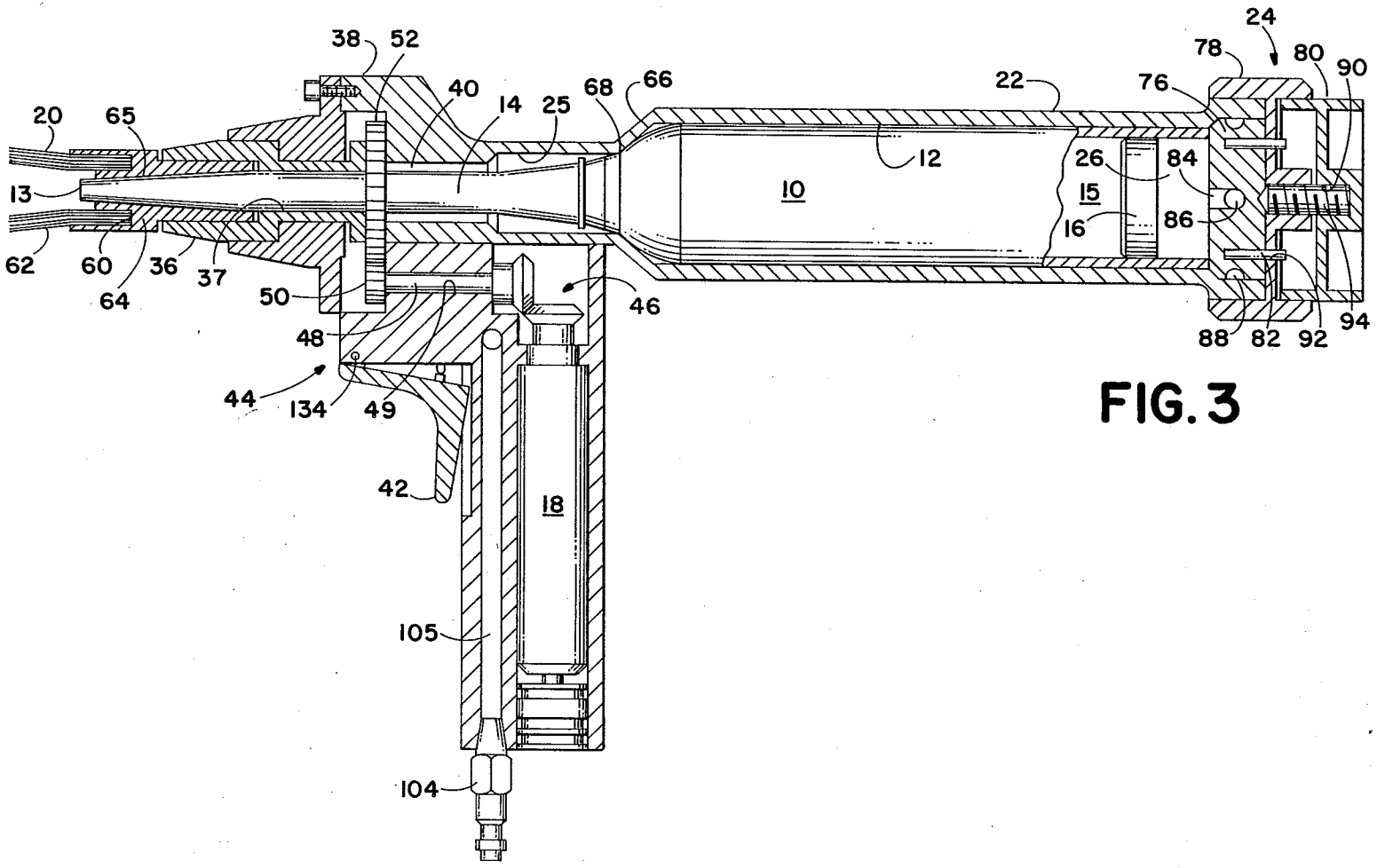
FIG. 3 is a sectional elevation view of the tool of FIG. 1.

As best shown in FIG. 3, gear train 44 coupling brush chuck 36 to motor 18 comprises a bevel gear set 46, a pinion shaft 48, a pinion 50 and a modification gear 52. Bevel gear set 46 couples motor 18 to pinion shaft 48. Pinion shaft 48, journalled in a bore 49 within forward section 38, is connected to pinion 50 which engages modification gear 52. Brush chuck 36 is attached to modification gear 52. Motor 18 rotates pinion shaft 48 through bevel gear set 46, and pinion shaft 48 rotates pinion 50. Pinion 50 in turn drives modification gear 52 thereby rotating brush chuck 36 and brush 20. Brush 20 has a recessed annular ring 60 receiving bristles 62 and a tapered tube 64 releasably attached to the brush chuck 36 through a bayonet fitting.

Casing 22 receives cartridge 10 with nozzle 14 extending through aperture 25 at a front end 66 of casing 22. Casing end 66 tapers to form a seal with cartridge 10 at a point 68 where nozzle 14 is attached to container 12. End plug assembly 24, including an end plug 76, an end cap 78, and a handscrew 80, secures cartridge 10 within casing 22 and seals casing 22 for pressurization.

End plug 76 fits snugly within flared end 70 of casing 22 and abuts container 12. End plug 76 has two alignment pins 82 extending toward the rear of the tool. End cap 78, having two small holes 92 for receiving alignment pins 82 of end plug 76, is secured to the rear end 70 of casing 22 by a bayonet coupling. Handscrew 80 includes a threaded bolt 94 screwed into a central threaded bore 90 of end cap 78. When an operator tightens handscrew 80, bolt 90 forces end plug 76 into sealing engagement with the open end of container 12, thereby forming air tight pressure chamber 26 behind plunger 16. End plug 76 has a central bore 84 and an air passageway 86 extending radially from bore 84 to a groove 88 in the radial surface of end plug 76. Groove 88 communicates with port 72 of FIG. 1. Pressurizing air from valve 102 flows through external air tube 74 and port 72 of FIG. 1, through groove 88, passageway 86 and bore 84 of end plug 76, and into pressure chamber 26.

Figure 4:
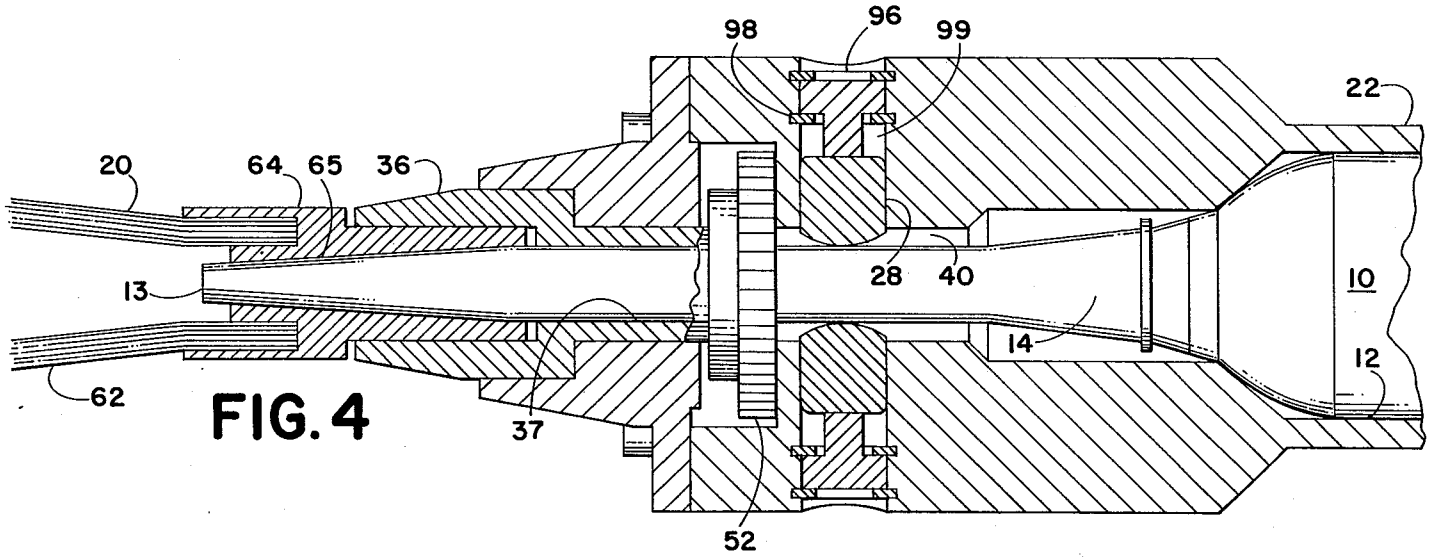
FIG. 4 is an enlarged sectional view on the line IV—IV of FIG. 1.

As shown in FIGS. 3 and 4, nozzle 14 of cartridge 10 extends through aperture 25 of casing 22, through a passageway 40 within forward section 38, through a central hole in modification gear 52, and through passageways 37 and 65 within chuck 36 and brush tube 64. The tip 13 of nozzle 14 protrudes into the ring of bristles 62. Tube 64 fits closely around nozzle 14 to inhibit flow of liquid back into the applicator tool but not so close as to prevent tube 64 from rotating about nozzle 14.

The flow control pistons 28 slip within cylinders 96 formed in forward section 38 and extend into passageway 40 on opposite sides of nozzle 14. Seals 98 installed in cylinders 96 behind pistons 28 seal airtight chambers 99 behind pistons 28. When valve 102 of FIG. 2 supplies air into chambers 99, pistons 28 move further into passageway 40, clamping the flexible nozzle 14 and restricting flow of liquid through the nozzle. When valve 102 vents air from chambers 99, pressure from liquid in nozzle 14 pushes pistons 28 outward and the liquid flows freely through the nozzle.

Figure 5:
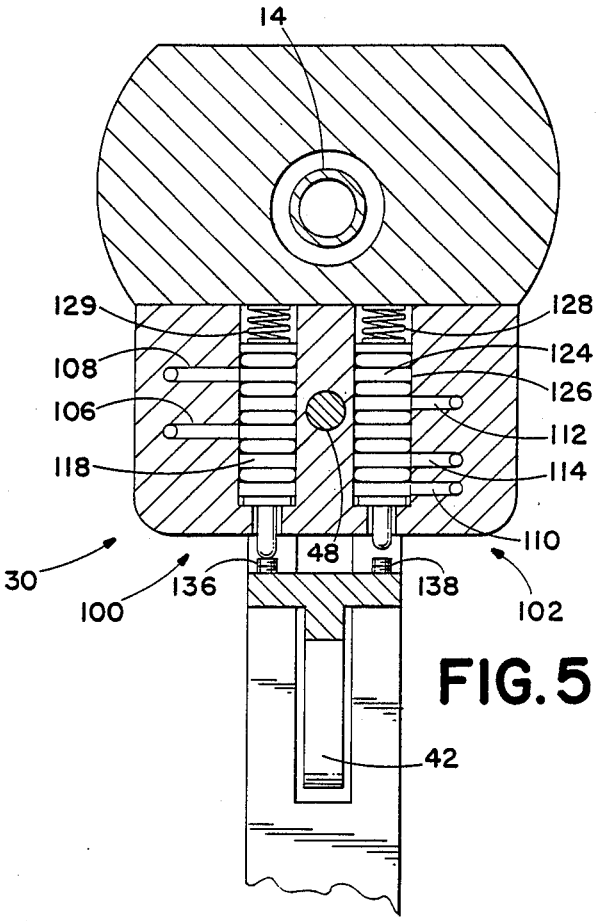
FIG. 5 is an enlarged sectional view on the line V—V of FIG. 1.

FIG. 5 shows the air flow control system 30, including values 100 and 102. As previously mentioned, and shown in FIG. 2, valve 100 controls air flow to pneumatic motor 18 of FIG. 3. Valve 102 controls air pressure within pressure chamber 99 behind pistons 28 of FIG. 4 and also controls air pressure within chamber 26 behind plunger 16 of FIG. 3. Valves 100 and 102 are located in forward section 38 directly above trigger 42 and to either side of the pinion shaft 48. Handle 32 includes a central passageway 105 (FIG. 3) extending from air intake 104 to an inlet passageway 106 supplying air to valve 100 and to an inlet passageway 110 supplying air to valve 102. An outlet passageway 108 channels air from valve 100 to the motor 18. Outlet passageways 112 and 114 deliver air from pressure valve 102 to pressure chambers 99 of FIG. 4 and to external air tube 74 of FIG. 1.

Air valve 100 comprises a cartridge 118. In a lowest position, cartridge 118 blocks the flow of air to the motor. When cartridge 118 moves upward to a second position, air flows through outlet passageway 108 to the motor.

Pressure valve 102 comprises a spool 124 and sleeve 126. In a lowest position, the spool channels air from inlet 110 through outlet 112 to pressure chamber 99 and vents pressure chamber 26 through passage 114. When spool 124 moves upward to a second position, it vents air from pressure chambers 99 and channels air from inlet 110 through outlet 114 to pressure chamber 26 via external air tube 74 of FIG. 1.

As best illustrated in FIGS. 1, 3 and 5, trigger 42 controlling valves 100 and 102 comprises an L-shaped member attached by pin 134 to the underside of forward section 38. Two set screws 136 and 138 in trigger 42 extend upward toward cartridge 118 of air valve 100 and spool 124 of pressure valve 102, respectively. When an operator releases trigger 42, screws 136 and 138 permit cartridge 118 and spool 124 to fall to their lowest positions thereby causing valves 100 and 102 to shut off air flow to motor 18 and vent chamber 26 while supplying air to chambers 99. A spool return spring 128 forces spool 124 into its lowest position and a spring 129 causes cartridge 118 to fall to its lowest position when the trigger is released. Thus when the operator releases trigger 42, no liquid is dispensed and the brush does not rotate. When the operator depresses trigger 42 to the second position, screw 136 moves cartridge 118 upward and valve 100 supplies air to the motor to rotate the brush. However in this second position set screw 138 does not engage spool 124 of valve 102 and the nozzle remains clamped shut. When the operator further depresses trigger 42 to the third position, screw 138 moves spool 124 upward causing valve 102 to supply air to pressure chamber 26 and to vent air from chambers 99. Thus with the trigger in the third position, the brush rotates and liquid flows from the cartridge.

The applicator tool of the present invention permits an operator to dispense liquid from a disposable cartridge while brushing the dispensed liquid onto a surface. Clamping pistons 28 of FIG. 4 allow the operator to easily and precisely start and stop liquid flow from the cartridge while the brush rotates.

Because the tip 13 of nozzle 14 extends into the center of the brush, and the interior of tapered tube 64 fits closely about nozzle 14, the liquid dispensed from cartridge 10 is effectively prevented from contacting any part of the applicator tool other than the brush 20. Therefore, the only clean-up operation that is necessary when the operator has finished dispensing liquid is disposal of the cartridge 10 and the brush 20.

While the described applicator tool utilizes compressed air to apply pressure to the cartride, the clamping pistons and the motor, it will be apparent to those skilled in the art that other pressurized fluids may be employed in lieu of the compressed air. As used herein the term "fluid" encompasses both gasses and liquids.

Accordingly, while a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A tool for dispensing liquid from a cartridge, the cartridge comprising a container for holding the liquid and a flexible nozzle, at least one part of the cartridge being movable relative to other parts of the cartridge to drive liquid from the container by way of the nozzle, the tool comprising:

a housing for holding the cartridge, said housing having an aperture through which the nozzle protrudes;

restrictor means attached to said housing actuable for clamping the nozzle to prevent liquid in the container from flowing through the nozzle; and control means attached to said housing for selectively applying force to said one part of the cartridge and actuating said restrictor means.

2. The tool in accordance with claim 1, wherein the container comprises a tube having first and second ends and said one part of the cartridge is a plunger slidably fitting within the tube, the nozzle being attached to the first end, the second end being open, the liquid being contained between the plunger and the first end, wherein a portion of said housing, the second end of the container, and the plunger define a pressure chamber such that when pressurized fluid is supplied to said pressure chamber, the plunger slides within the tube toward the nozzle driving liquid from the container through the nozzle, and wherein said control means comprises means for selectively supplying pressurized fluid to said pressure chamber.

3. The tool in accordance with claim 1 wherein said restrictor means comprises a cylinder attached to said housing proximate the nozzle, and a piston slidably fitting within said cylinder, a portion of said cylinder and said piston forming a pressure chamber for receiving pressurized fluid such that when the pressurized fluid is supplied to said pressure chamber, said piston slides within said cylinder toward the nozzle, engaging and clamping the nozzle, and wherein said control means comprises means for selectively supplying pressurized fluid to the pressure chamber.

4. The tool in accordance with claim 1, wherein the container comprises a tube having first and second ends and said one part of the cartridge is a plunger slidably fitting within the tube, the nozzle being connected to the first end, the second end being open, the liquid being contained between the plunger and the first end, wherein a portion of said housing, the second end of the container, and the plunger define a first pressure chamber such that when pressurized fluid is supplied to said first pressure chamber, the plunger slides within said tube toward the nozzle driving liquid from the container through the nozzle, wherein said restrictor means comprises a cylinder attached to said housing proximate the nozzle and a piston slidably fitting within said cylinder, a portion of said cylinder and said piston forming a second pressure chamber for receiving pressurized fluid such that when said pressurized fluid is supplied to said second pressure chamber, said piston slides within said cylinder toward the nozzle to engage and clamp the nozzle, and wherein said control means comprises manually operable means for alternatively supplying pressurized fluid to said first and second pressure chambers.

5. The tool in accordance with claim 4 wherein said manually operable means comprises:

manually operable trigger means attached to said housing; and valve means attached to said housing, responsive to operation of said trigger means and coupled for alternatively supplying pressurized fluid to said first and second pressure chambers.

6. A tool in accordance with claim 1, further comprising:

brush means rotatably attached to said housing, said nozzle protruding into said brush means for dispensing liquid from the cartridge into said brush means, and motor means attached to said housing for rotating said brush means such that the brush means applies liquid dispensed through the nozzle onto a surface.

7. A tool for dispensing liquid from a cartridge and for applying the dispensed liquid to a surface, the cartridge comprising a container for holding the liquid and a nozzle at least one part of the cartridge being movable relative to other parts of the cartridge to drive liquid from the container by way of the nozzle, the tool comprising:

a housing for holding the cartridge, said housing having an aperture through which a portion of the nozzle protrudes;

control means attached to said housing for selectively applying force to said one part of the cartridge;

brush means rotatably attached to said housing, said portion of the nozzle protruding into said brush means for dispensing liquid from the container into said brush means; and motor means attached to said housing for rotating said brush means such that said brush means applies liquid dispensed through the nozzle onto said surface.

8. The tool in accordance with claim 7, wherein the container comprises a tube having first and second ends and said one part of the cartridge is a plunger slidably fitting within said tube, the nozzle being connected to said first end, said second end being open, the liquid being contained between the plunger and the first end, wherein a portion of said housing, the second end of the container, and the plunger define a pressure chamber such that when pressurized fluid is supplied to said pressure chamber the plunger slides within said tube toward the nozzle driving liquid from the container through the nozzle, and wherein said control means comprises manually operated means for selectively supplying fluid to said pressure chamber.

9. A tool for dispensing liquid from a cartridge and for applying the dispensed liquid to a surface, the cartridge comprising a container for holding the liquid and a flexible nozzle, at least one part of the cartridge being movable relative to other parts of the cartridge to drive liquid from the container by way of the nozzle, the tool comprising:

a housing for holding the cartridge, said housing including an aperture through which a portion of the nozzle protrudes;

control means attached to said housing for selectively applying force to said one part of the cartridge;

restrictor means attached to said housing for selectively clamping the nozzle to prevent liquid in the container from flowing through the nozzle; and brush means attached to said housing, said portion of the nozzle protruding into said brush means for dispensing liquid from the container into said brush means.

10. The tool in accordance with claim 9, wherein the conntainer comprises a tube having first and second ends and said one part of the cartridge is a plunger slidably fitting within said tube, the nozzle being attached to said first end, said second end being open, the liquid being contained between the plunger and the first end, wherein a portion of said housing, the second end of the container, and the plunger define a pressure chamber such that when pressurized fluid is supplied to said pressure chamber, the plunger slides within said tube toward the nozzle driving liquid from the container through the nozzle, and wherein said control means comprises means for selectively supplying pressurized fluid to said pressure chamber.

11. The tool in accordance with claim 9 wherein said restrictor means comprises:

a cylinder attached to said housing proximate the nozzle; and a pistion slidably fitting within said cylinder, a portion of said cylinder and said piston forming a pressure chamber for receiving pressurized fluid such that when said pressurized fluid is supplied to said pressure chamber, said piston slides within said cylinder toward the nozzle, engaging and clamping the nozzle.

12. The tool in accordance with claim 9, wherein the container comprises a tube having first and second ends and said one part of the cartridge is a plunger slidably fitting within said tube, the nozzle being connected to the first end, the second end being open, the liquid being contained between the plunger and the first end, wherein a portion of said housing, the second end of the container, and the plunger define a first pressure chamber such that when pressurized fluid is supplied to said first pressure chamber, the plunger slides within said tube toward the nozzle driving liquid from the container through the nozzle, wherein said restrictor means comprises a cylinder attached to said housing proximate the nozzle and a piston slidably fitting within said cylinder, a portion of said cylinder and said piston forming a second pressure chamber for receiving pressurized fluid such that when said pressurized fluid is supplied to said second pressure chamber, said piston slides within said cylinder toward the nozzle, engaging and clamping the nozzle, and wherein said control means comprises manually operable means attached to said housing for alternatively supplying pressurized fluid to said first and second pressure chambers.

13. The tool in accordance with claim 10 wherein said manually operable means comprises:

manually operable trigger means attached to said housing; and valve means attached to said housing, responsive to operation of said trigger means and coupled for alternatively supplying pressurized fluid to said first and second pressure chambers.

14. A tool for dispensing liquid from a cartridge and for applying the dispensed liquid to a surface, the cartridge comprising a container for holding the liquid, a flexible nozzle at a first end of the container for dispensing the liquid from the container, and a plunger slidably fitting within a second end of the container such that the liquid is contained between the nozzle and the plunger, the second end of the container being open, the tool comprising:

a housing for holding the cartridge wherein a portion of said housing, the second end of the container, and the plunger define a first pressure chamber such that when pressurized gas is supplied to said first pressure chamber, the plunger applies pressure on the liquid in the container to drive liquid from the container through the nozzle, said housing having an aperture through which a portion of the nozzle protrudes and a coupling for receiving pressurized gas from an external source of pressurized gas;

restrictor means attached to said housing for clamping the nozzle to prevent liquid in the container from flowing through the nozzle when pressurized gas is supplied to said restrictor means;

brush means mounted for rotating on said housing about said portion of the nozzle protruding through said aperture such that the nozzle protrudes into said brush means and dispenses liquid from the container into said brush means, such that when said brush means rotates its brushes dispensed liquid onto said surface;

a pneumatic motor attached to said housing for rotating said brush means when pressurized gas is supplied to said motor means; and manually operated control means attached to said coupling for selectively supplying pressurized gas received from said source to said first pressure chamber, to said restrictor means and to said pneumatic motor.

15. The tool in accordance with claim 12 wherein said restrictor means comprises:

a cylinder adjacent the nozzle; and a piston slidably fitting within said cylinder, a portion of said cylinder and said piston forming a second pressure chamber for receiving said pressurized fluid such that when said pressurized gas is supplied to said second pressure chamber, said piston slides within said cylinder to engage and clamp the nozzle.

16. The tool in accordance with claim 15 wherein said control means comprises:

manually operable trigger means attached to said housing; and valve means linked to said trigger means for selectively supplying pressurized air from said source to said first and second pressure chambers and to said motor means in response to operation of said trigger means.

17. A tool for dispensing liquid from a cartridge and for applying the dispensed liquid to a surface, the cartridge comprising a container for holding the liquid and a nozzle, at least one part of the cartridge being movable relative to other parts of the cartridge to drive liquid from the container by way of the nozzle, the tool comprising:

a housing for holding the cartridge, said housing having an aperture through which a portion of the nozzle protrudes;

control means attached to said housing for selectively applying force to said one part of the cartridge;

restrictor means attached to said housing for selectively clamping the nozzle to prevent liquid in the container from flowing through the nozzle;

brush means rotatably attached to said housing, said portion of the nozzle protruding into said brush means for dispensing liquid from the container into said brush means;

motor means attached to said housing for selectively rotating said brush means such that said brush means applies liquid dispensed through the nozzle onto said surface; and manual actuator means attached to said housing and coupled to said control means, said restrictor means and said motor means, and having a first position wherein said restrictor means clamps the nozzle, a second position wherein said restrictor means clamps the nozzle and said motor means rotates said brush means, and a third position wherein said motor means rotates said brush means and said control means applies force to said one part of the cartridge.

* * * * *

UNITED STATES PATENT AND TRADEMARK OFFICE

CERTIFICATE OF CORRECTION

PATENT NO. : 4,932,094

DATED : June 12, 1990

INVENTOR(S) : PETER D. McCOWIN

It is certified that error appears in the above-identified patent and that said Letters Patent is hereby corrected as shown below:

Column 2, line 23, "surface" should be --subject--.

Column 8, line 14, "conntainer" should be --container--.

Signed and Sealed this

Sixteenth Day of July, 1991

*Attest:*

HARRY F. MANBECK, JR.

*Attesting Officer*

*Commissioner of Patents and Trademarks*